United States Patent [19]

Nogata et al.

[11] Patent Number: 4,746,887

[45] Date of Patent: May 24, 1988

[54] HOLLOW CYLINDRICAL MOVABLE BODY FOR AN ELECTROMAGNET

[75] Inventors: Osamu Nogata; Takashi Kajima, both of Kobe; Toshiharu Ozaki, Ohsaka, all of Japan

[73] Assignee: Techonological Research Association, Tokyo, Japan

[21] Appl. No.: 771,772

[22] Filed: Sep. 3, 1985

[30] Foreign Application Priority Data

Sep. 6, 1984 [JP] Japan ..... 59-187034
Sep. 6, 1984 [JP] Japan ..... 59-187035

[51] Int. Cl.[4] ..... H01F 7/08
[52] U.S. Cl. ..... 335/261; 335/279
[58] Field of Search ..... 335/243, 249, 250, 251, 335/261, 266, 279

[56] References Cited

U.S. PATENT DOCUMENTS 2,448,727 9/1948 Oetzel ..... 335/264 X
3,013,189 12/1961 Bernier ..... 335/261 X
3,553,618 1/1971 Lang ..... 335/251 X
4,067,541 1/1978 Hunter ..... 335/260
4,438,419 3/1984 Helinski ..... 335/261

FOREIGN PATENT DOCUMENTS 2713144 10/1977 Fed. Rep. of Germany ..... 335/261
2751685 5/1978 Fed. Rep. of Germany ..... 335/261
3313294 10/1984 Fed. Rep. of Germany ..... 335/261
2105912 3/1983 United Kingdom ..... 335/261
2140214 11/1984 United Kingdom ..... 335/261

*Primary Examiner*—George Harris
*Attorney, Agent, or Firm*—Cushman, Darby & Cushman

[57] ABSTRACT

An electromagnet includes a lightweight movable body in the form of a hollow cylindrical body. The resistances of circulation paths for eddy currents flowing in the movable body due to electromagnetic induction are increased to suppress the eddy currents. Excitation coils are connected parallel to each other to reduce the coil inductance for increasing the magnetic forces to attract the movable body and the response thereof.

11 Claims, 9 Drawing Sheets

HOLLOW CYLINDRICAL MOVABLE BODY FOR AN ELECTROMAGNET

BACKGROUND OF THE INVENTION

1. Field of the Invention

The present invention relates to an electromagnet for use in a solenoid-operated valve in a hydraulic system, an electromagnetic switch, or the like.

2. Description of the Prior Art

Conventional electromagnets used in solenoid-operated valves or electromagnetic switches are composed of a coil disposed around a yoke and a movable body such as a plunger inserted in the yoke and movable into out of the yoke in response to energization and de-energization of the coil for opening and closing the valve or switch. The electromagnets in the valves and switches are required to produce large magnetic forces and move the movable body with a high response.

The magnetic forces are related to the magnetic material and dimensions of the electromagnet and the cross-sectional area of the movable body which forms a magnetic circuit. Magnetic materials having higher saturation flux densities can produce greater magnetic forces. The response can be increased by passing a high exciting current momentarily to induce a magnetic flux for magnetizing the yoke rapidly for increasing the magnetic force. However, when a large magnetic flux is to be generated in a short period of time, a high eddy current flows in the magnetic material due to electromagnetic induction, and the eddy current is responsible for producing a magnetic flux in the opposite direction which cancels the magnetic flux produced by energizing the coil. Therefore, the magnetic force cannot be produced effectively, and the response cannot be increased.

The eddy current is produced in both the fixed yoke and the movable body. The magnitude of the eddy current is proportional to the rate of time-dependent change of the magnetic flux and the reciprocal of the resistivity of the magnetic material which the electromagnet is made of. Therefore, use of a magnetic material of a high resistivity can reduce the eddy current and increase the response of the movable body. Since the magnetic materials are generally electrically conductive, however, it is impossible to suppress the eddy current. Even if magnetic materials having relatively large resistivities such as a dust core, for example, are employed, difficulty arises in attaining sufficient magnetic forces with predetermined dimensions since such magnetic materials have low saturation flux densities. More specifically, to produce sufficient magnetic forces, the cross-sectional area of the magnetic path should be increased. Although the performance of the electromagnet would not be affected by substantially increasing the cross-sectional area of the magnetic path of the yoke, an increase in the cross-sectional area of the magnetic path of the movable body would result in a larger weight and a reduced deceleration of the movable body, thus making the movable body less responsive. Another way of reducing the eddy current would be to employ a lamination of silicon steel plates since silicon steel has a low electric conductivity and the lamination of silicon steel plates is effective for reducing the cross-sectional area through which the current flows and hence for increasing the electrical resistance. However, such a proposal would be disadvantageous in that it would be difficult to machine the silicon steel plates and the structure would easily be damaged or broken under external forces applied.

SUMMARY OF THE INVENTION

In view of the aforesaid difficulties of the conventional electromagnetics, it is an object of the present invention to provide an electromagnet including a movable body composed of a hollow cylinder having a thin wall to attain an effective cross-sectional area for a magnetic path without increasing the weight, so that the magnetic reaction produced by an eddy current can be reduced to increase magnetic forces for an increased response.

According to the present invention, a fixed body is composed of yokes of a magnetic material which support coils disposed therearound and are axially juxtaposed, and a movable body composed of axially coupled cylindrical magnetic members and axially movably fitted over the fixed body. The movable body may have axially parallel slits.

When the coils on the yokes are energized to magnetize the yokes, the movable body is axially attracted under magnetic forces produced by the yokes. At this time, eddy currents are induced in the movable body due to induction based on the magnetization of the yokes. The eddy currents flow in the circumferential direction of the movable body, and the magnetic fluxes generated by the eddy currents tend to cancel out the magnetic forces generated by the magnetization of the yokes. Since the circulation paths for the eddy currents are cylindrical, they are narrow and long. Therefore, the circulation paths have large electric resistances to suppress the eddy currents. The magnetic forces generated by the energization of the coils are accordingly prevented from being cancelled by the eddy currents. The circulation paths are interrupted by the axially parallel slits in the movable body for larger electric resistances of the circulation paths. The excitation coils of the fixed body are connected parallel to each other for a reduced coil inductance, so that a large exciting current can be passed through the coils. As a result, the electromagnet can produce increased magnetic forces for attracting the movable body with an increased response.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
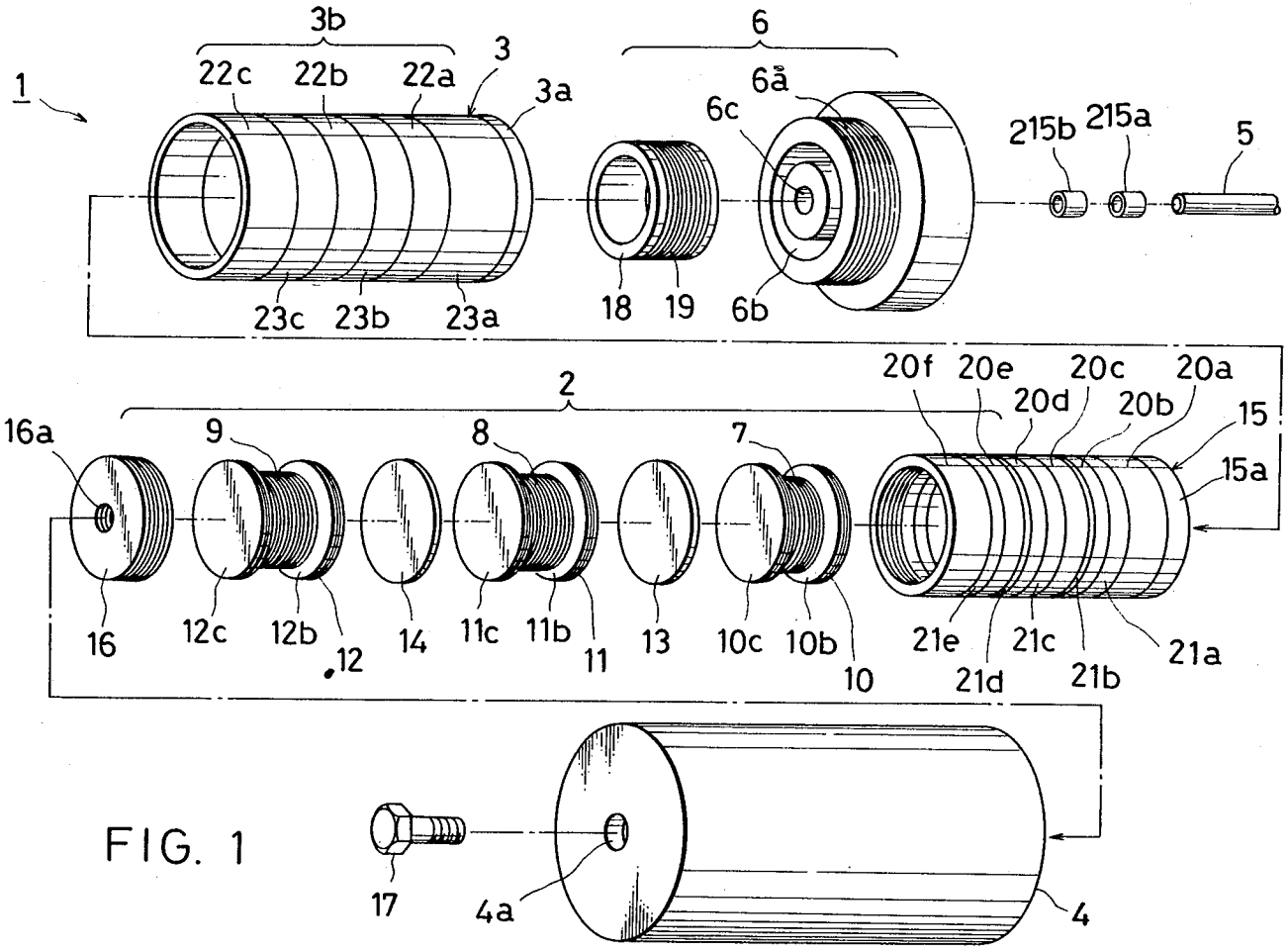
FIG. 1 is an exploded perspective view of an electromagnet according to a first embodiment of the present invention.
Figure 2:
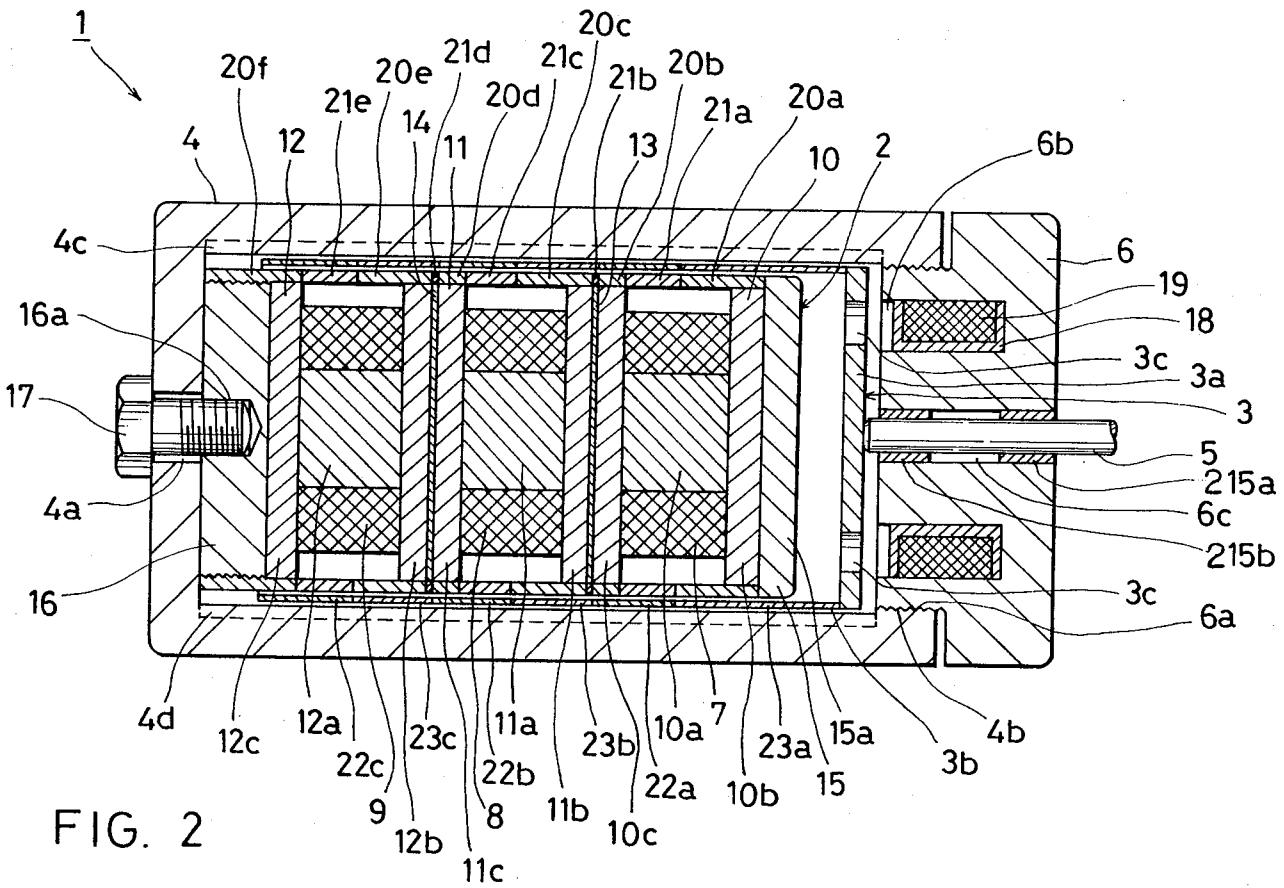
FIG. 2 is a longitudinal cross-sectional view of the electromagnet shown in FIG. 1.

An electromagnet according to a first embodiment of the present invention is illustrated in FIGS. 1 and 2.

The electromagnet, generally designated at 1, is primarily used for incorporation in a double-solenoid-type solenoid-operated valve, for example, for use in a hydraulic circuit. The electromagnet 1 is generally composed of a fixed body 2, a movable body 3 axially movably fitted over the fixed body 2, a casing 4 to which the fixed body 2 is fixed and which protects the movable body 3, and a base 6 threaded in the casing 4 and supporting a shaft 5 connected to the spool in a control valve, for example.

The fixed body 2 comprises a plurality of yokes 10, 11, 12 composed respectively of shafts 10*a*, 11*a*, 12*a* each in the form of a lamination of transversely stacked magnetic members such as silicon steel plates, flanges 10*b*, 10*c*; 11*b*, 11*c*; 12*b*, 12*c* mounted on the ends of the shafts 10*a*, 11*a*, 12*a*, respectively, and each in the form of a lamination of axially stacked magnetic members such as silicon steel plates, and coils 7, 8, 9 disposed around the yokes 10, 11, 12, respectively. The yokes 10, 11, 12 are axially juxtaposed with disks 13, 14 of a nonmagnetic material interposed between the yokes 10, 11, and between the yokes 11, 12. The yokes 10, 11, 12 are fitted in a bottomed cylindrical body 15, and fixedly positioned therein by a cover 16 of a nonmagnetic materials attached to the open end of the cylindrical body 15. The bottomed cylindrical body 15 includes a bottom 15*a* made of a non-magnetic material and a cylindrical portion composed of alternately arranged magnetic members 20*a* through 20*f* and nonmagnetic members 21*a* through 21*e* which are joined together. The magnetic members 20*a*, 20*c*, 20*e* are positioned such that their front end surfaces (at righthand ends in FIGS. 1 and 2) are held in radial alignment with the righthand end surfaces of the flanges 10*b*, 11*b*, 12*b* of the yokes 10, 11, 12. The other end surfaces of the magnetic members 20*a*, 20*c*, 20*e* are positioned in radial alignment with the axially intermediate portions of the shafts 10*a*, 11*a*, 12*a*, respectively. The other magnetic members 20*b*, 20*d*, 20*f* have axial dimensions which are equal to the widths of the flanges 10*c*, 11*c*, 12*c*, respectively, at their outer peripheries, which are positioned on the rear ends (at lefthand ends in FIGS. 1 and 2). The nonmagnetic members 21*a*, 21*c*, 21*e* are interposed between the magnetic members 20*a*, 20*b*; 20*c*, 20*d*; 20*e*, 20*f*, respectively. The disks 13, 14 disposed axially between the flanges 10*c*, 11*b*; 11*c*, 12*b* are surrounded by the nonmagnetic members 21*b*, 21*d*, respectively. The magnetic member 20*f* positioned on the outer peripheral surface of the flange 12*c* has a rear extension to the left (FIG. 2) which has an internally threaded inner surface with which the cover 16 is held in threaded engagement.

The movable body 3 is composed of a side plate 3*a* of a magnetic material and a cylindrical portion 3*b* comprising alternately arranged magnetic members 22*a*, 22*b*, 22*c* and nonmagnetic members 23*a*, 23*b*, 23*c* which are axially joined together. The cylindrical portion 3*b* has a wall thickness of about 1 mm and is assembled over the fixed body 2 from the front end thereof (at the righthand end in FIGS. 1 and 2).

The movable body 3 is positioned in its center of stroke of movement and subject to maximum attractive forces when the righthand front ends of the magnetic members 22*a*, 22*b*, 22*c* of the movable body 3 are radially aligned with the lefthand rear ends of the magnetic members 20*a*, 20*c*, 20*e* of the fixed body 2. When the coils 7, 8, 9 are not energized and hence the yokes 10, 11, 12 are not magnetized, the movable body 3 is positioned leftward of the position of FIG. 2. When the yokes 10, 11, 12 are magnetized, the movable body 3 is axially attracted to the right and overlaps the magnetic members 22*a*, 22*b*, 22*c* to respective positions the magnetic members 20*a*, 20*c*, 20*e*, of the fixed body 2. The stroke which the movable body 3 traverses at this time can be controlled by positionally adjusting the fixed body 2 back and forth with a bolt 17 extending through a hole 4*a* in the casing 4 threadedly into a threaded hole 16*a* in the cover 16 and also by turning the base 6 for positional adjustment with respect to the casing 4.

As shown in FIG. 2, the side plate 3*a* of the movable body 3 has axial through holes 3*c* for passage therethrough of working oil into and out of the movable body 3. The casing 4 is in the form of a bottomed cylindrical body with the hole 4*a* defined in the bottom thereof. The casing 4 has axially parallel slots 4*c*, 4*d* defined in the inner wall surface for passage therethrough of the working oil in the casing 4. In assembly, the fixed body 2 housed in the casing 4 is fixed to the casing 4 by the bolt 17 extending through the hole 4*a* threaded into the hole 16*a* after the fixed body 2 has been positionally adjusted with respect to the casing 4. After the fixed body 2 is fixedly mounted in the casing 4, the cylindrical portion 3*b* of the movable body 3 is fitted into an annular spaced defined between the outer circumferential surface of the fixed body 2 and the inner circumferential surface of the casing 4.

The base 6 is substantially in the form of two integral disks of different diameters which are axially juxtaposed. The smaller-diameters disk portion has an externally threaded surface 6*a* held in threaded engagement with an internally threaded surface 4*b* of the casing 4. The base 6 has a central through hole 6*c* housing bearings 215*a*, 215*b* fitted therein and supporting a shaft 5. The base 6 has an annular recess 6*b* opening at an end face thereof into the casing 4 in concentric relation to the hole 6*c*, the annular recess 6*b* having a prescribed radius and a rectangular cross section. A coil 19 disposed around a bobbin 18 is accommodated in the annular recess 6*b*. In assembly, the base 6 is fixed to the casing 4 by bringing the externally threaded surface 6*a* into threaded engagement with the internally threaded surface 4*b* of the casing 4.

Figure 3:
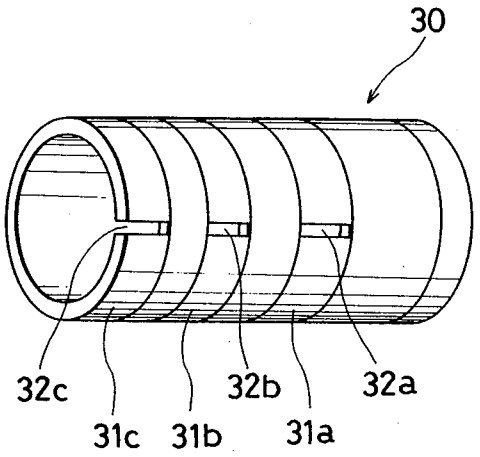
FIG. 3 is a perspective view of another movable body.

FIG. 3 shows another movable body 30 according to a modification of the present invension. The movable body 30 including magnetic members 31*a*, 31*b*, 31*c*, corresponding to the magnetic members 22*a*, 22*b*, 22*c* of the movable body 3, having axially parallel slits 32*a*, 32*b*, 32*c*, respectively. The slits 32*a*, 32*b*, 32*c* serve to increase the electric resistances of circulation paths for eddy currents induced by the magnetization of the yokes. Although only one slit is defined in each of the magnetic members 31*a*, 31*b*, 31*c* in a circumferential position thereof in the illustrated embodiment, a plurality of such slits may be defined in each of the magnetic members 31*a*, 31*b*, 31*c* in circumferential positions thereof. Furthermore, insulating materials may be disposed in the slits 32*a*, 32*b*, 32*c* for preventing the mechanical strength of the magnetic members from being lowered.

Figure 4:
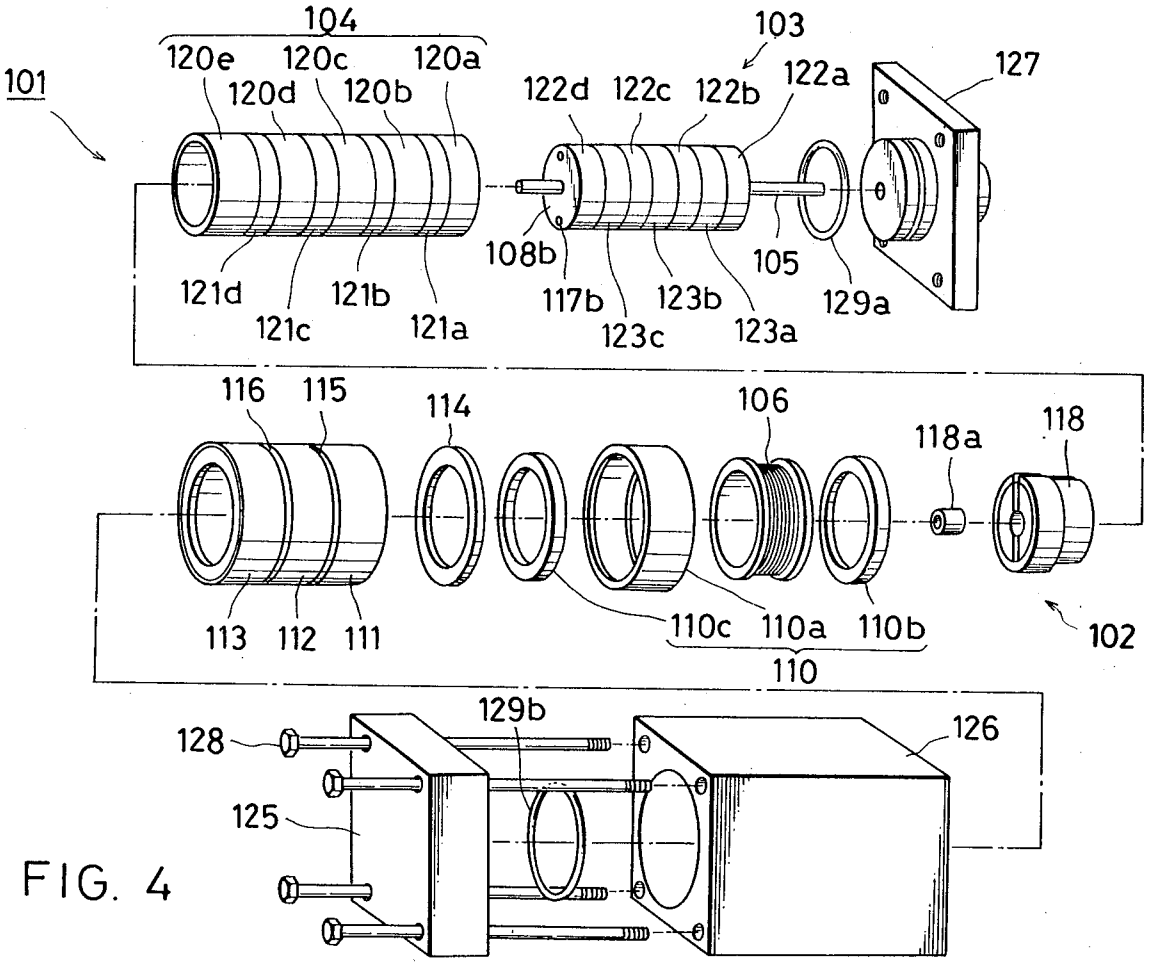
FIG. 4 is an exploded perspective view of an electromagnet according to a second embodiment of the present invention.
Figure 5:
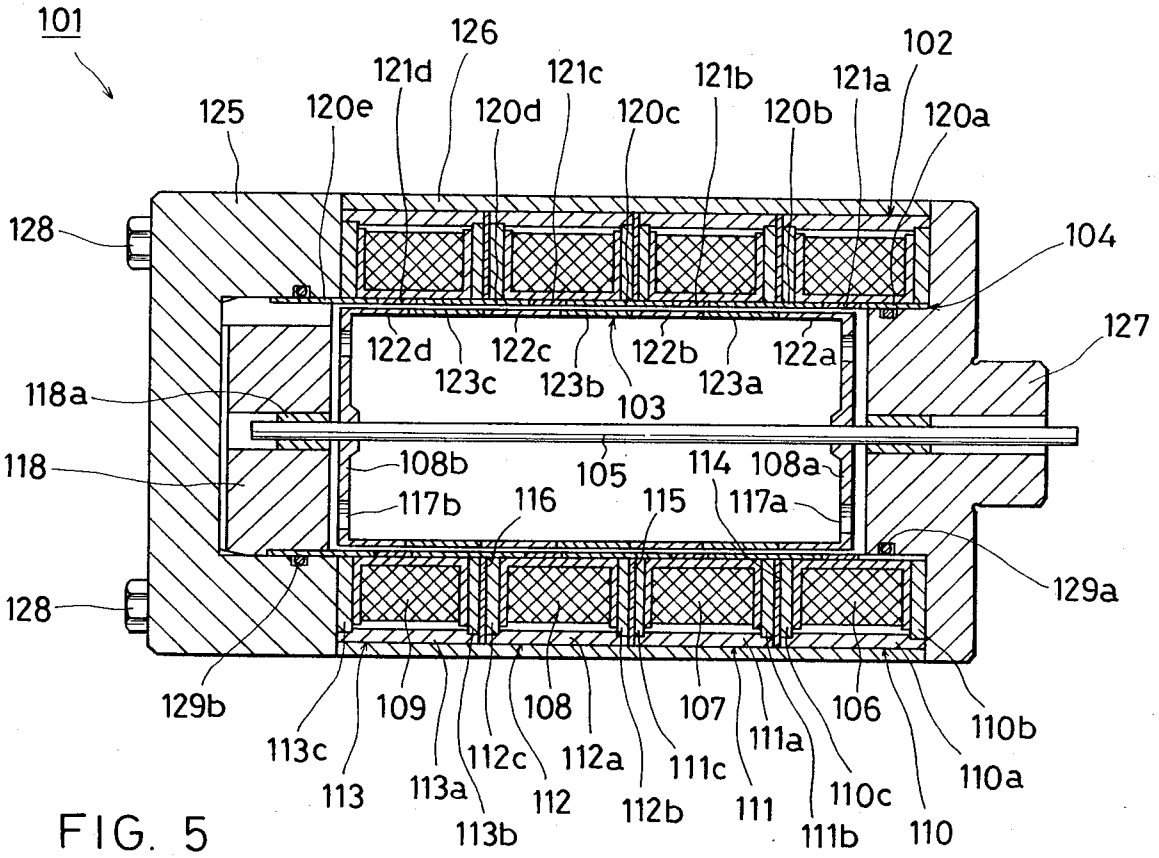
FIG. 5 is a longitudinal cross-sectional view of the electromagnet shown in FIG. 4.

FIGS. 4 and 5 illustrate an electromagnet 101 according to a second embodiment of the present invention. The electromagnet 101 is also primarily used for incorporation in a double-solenoid-type solenoid-operated valve, for example, for use in a hydraulic circuit. The electromagnet 101 is generally composed of a fixed body 102 and a movable body 103 axially movably fitted in the fixed body 102.

The fixed body 102 comprises a plurality of yokes 110, 111, 112, 113 composed respectively of cylindrical shafts 110*a*, 111*a*, 112*a*, 113*a* of a magnetic material, flanges 110*b*, 110*c*, 111*b*, 111*c*, 112*b*, 112*c*, 113*b*, 113*c*, mounted on the ends of the shaft 110*a*, 111*a*, 112*a*, 113*a*, respectively, and positioned radially inwardly thereof, each flange being in the form of a lamination of axially stacked magnetic members such as silicon steel plates, and coils 106, 107, 108, 109 disposed in and around the yokes 110, 111, 112, 113, respectively. The yokes 110, 111, 112, 113 are axially juxtaposed with annular disks 114, 115, 116 of a nonmagnetic material interposed between the yokes 110, 111; 111, 112; 112, 113 to keep these yokes axially spaced. A cylindrical body 104 is fitted and fixed in the axially juxtaposed yokes 110, 111, 112, 113. The cylindrical body 104 is composed of alternately arranged magnetic members 120*a* through 120*e* and nonmagnetic members 121*a* through 121*d*. The magnetic members 120*a* through 120*e* are positionally radially inwardly of the flanges 110*b* through 113*b*, 110*c* through 113*c*. The magnetic member 120*a* has a front end (righthand end in FIGS. 4 and 5) held in radial alignment with the front end of the flange 110*b* and a rear end (lefthand end) extending axially to a position held in radial alignment with the axially intermediate portion of the cylindrical shaft 110*a*. The magnetic members 120*b* through 120*e* have front ends projecting rightward slightly beyond the front ends of the flanges 110*c* through 113*c* and rear ends axially extending to positions held in radial alignment with the axially intermediate portions of the cylindrical shafts 111*a* through 113*a*. The nonmagnetic members 121*a* through 121*d* are positioned axially between the magnetic members 120*a*, 120*b*; 120*b*, 120*c*; 120*c*, 120*d*; 120*d*, 120*e*, respectively. The rear end of the magnetic member 120*e* positioned radially inwardly of the flange 113*c* has a rearward extension in which a support 118 is fitted to support the rear end of the fixed body 102.

The movable body 103 is in the form of a cylinder comprising alternately arranged cylindrical magnetic members 122*a* through 122*d* of thin sheets and cylindrical nonmagnetic members 123*a* through 123*c*. The movable body 103 also includes end plates 108*a*, 108*b* attached to the opposite ends of the assembly of the magnetic and nonmagnetic members, and a shaft 105 extending centrally through the end plates 108*a*, 108*b*. The end plates 108*a*, 108*b* have holes 117*a*, 117*b* for passage therethrough of working oil in and out of the movable body 103.

The movable body 103 is positioned in its center of stroke of movement and subject to maximum attractive forces when the righthand front ends of the magnetic members 122*a* through 122*d* of the movable body 103 are radially aligned with the lefthand rear ends of the magnetic members 120*a* through 120*d* of the fixed body 102. When the yokes 110 through 113 are not magnetized, the movable body 103 is positioned leftward of the position of FIG. 5. When the yokes 110 through 113 are magnetized, the movable body 103 is axially attracted to the right to move the front ends of the magnetic members 122*a*, 122*b*, 122*c*, 112*d* into respective positions of the magnetic members 120*a*, 120*b*, 120*c*, 120*d* of the fixed body 2. The stroke which the movable body 103 traverses of this time can be controlled by the axial thicknesses of the support 118 and a base 127, described below.

In assembly, a cover 125 is attached to the rear end of the fixed body 102 in covering relation to the support 118 by which the rear end of the shaft 105 is supported. A casing 126 is fitted over the cylindrical shafts 110*a* through 113*a*. Then, the movable body 103 is fitted into the fixed body 102 from its front end. The rear end of the shaft 105 is fitted in and supported by a bearing 118*a* on the support 118, and the front end of the shaft 105 is held in the base 127 fitted in the front end of the fixed body 102. The cover 125, the casing 126, and the base 127 are fastened together by bolts 128. Oil seals 129*a*, 129*b* are interposed between the confronting surfaces of the cover 125 and the fixed body 102 and the base 127 and the fixed body 102 for preventing the working oil from leaking out.

Figure 6:
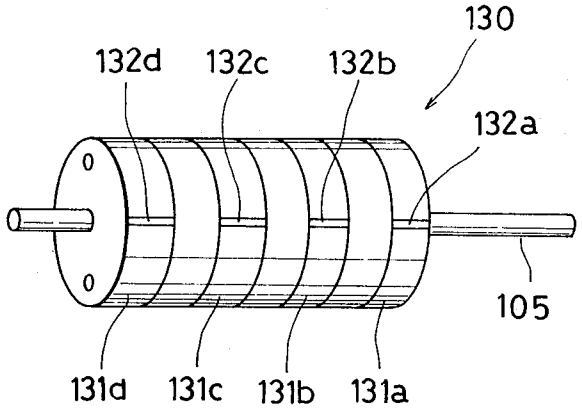
FIG. 6 is a perspective view of still another movable body.

FIG. 6 shows still another movable body 130 according to another modification of the present invention. The movable body 130 including magnetic members 131*a* through 131*d*, corresponding to the magnetic members 122*a* through 122*d* of the movable body 103, having axially parallel slits 132*a* through 132*d*, respectively. These slits are effective to increase the electric resistances of circulation paths for eddy currents induced by the magnetization of the yokes. Although only one slit is defined in each of the magnetic members 131*a* through 131*d* in a circumferential position thereof in the illustrated embodiment, a plurality of such slits may be defined in each of the magnetic members 131*a* through 131*d* in circumferential positions thereof. Furthermore, insulating materials may be disposed in the slits 132*a* through 132*d* for preventing the mechanical strength of the magnetic members from being lowered.

Figure 7:
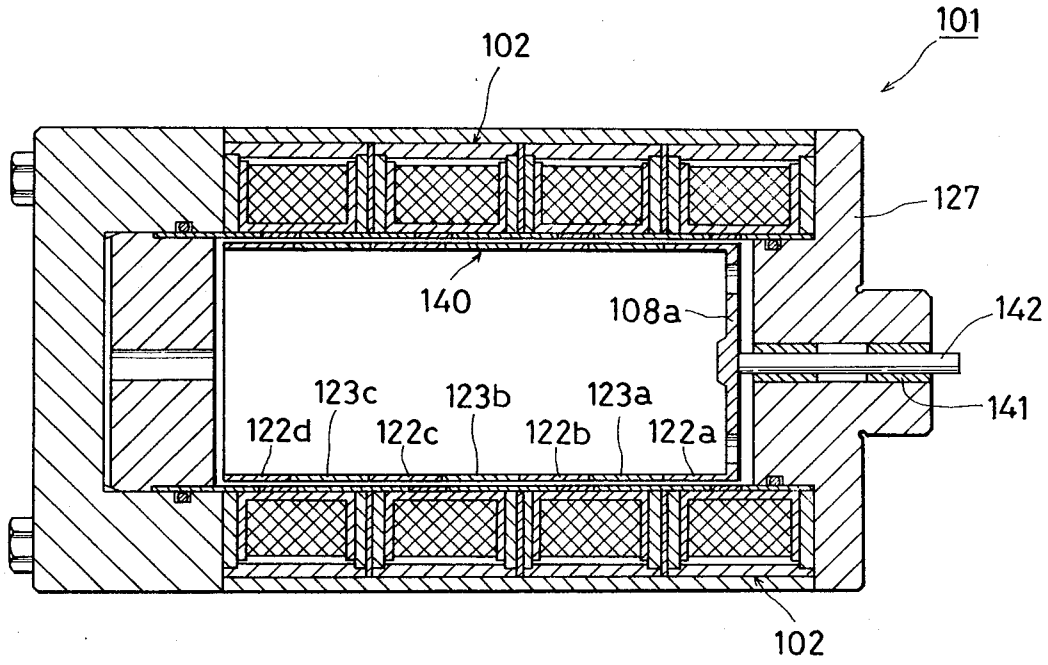
FIG. 7 is a longitudinal cross-sectional view of an electromagnet employing another movable body.

FIG. 7 shows an electromagnet 101 including another modified movable body 140. The movable body 140 is composed of a cylindrical assembly comprising alternately arranged magnetic members 122*a* through 122*d* and nonmagnetic members 123*a* through 123*c*, and a single end plate 108*a* joined to the cylindrical assembly to support the same. The movement of the movable body 140 is transmitted by a shaft 142 supported by bearings 141 fitted in a base 127. The movable body 140 of this construction is less heavy for higher-speed operation. The sliding surface of the movable body 140 may be finished to a higher accuracy for reducing friction between the fixed body and the movable body. Where the electromagnet is of the wet-type, the presence of oil on the sliding surface of the body 140 also allows the movable body 140 to move at a higher speed without suffering from frictional resistance.

Figure 8A:
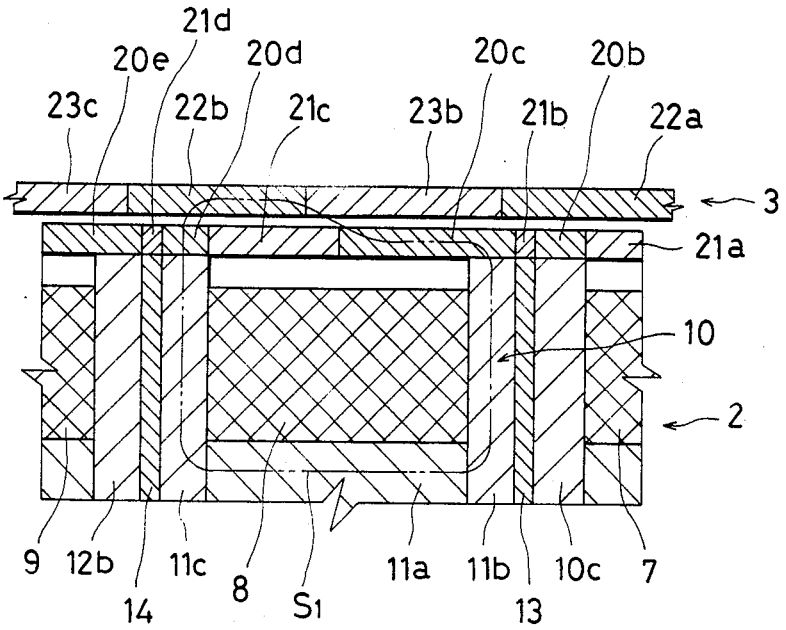
FIGS. 8(A) and 8(B) are enlarged fragmentary cross-sectional views showing operation of the electromagnet of FIG. 1.
Figure 8B:
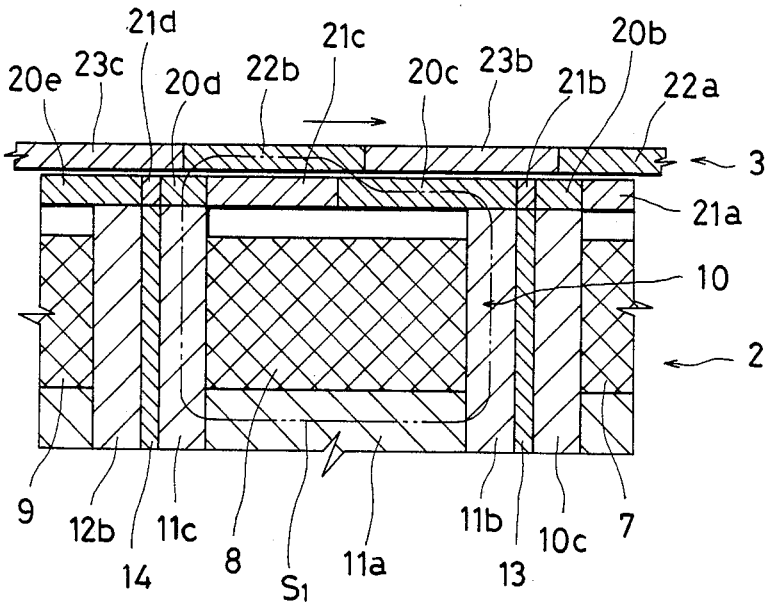
Figure 9:
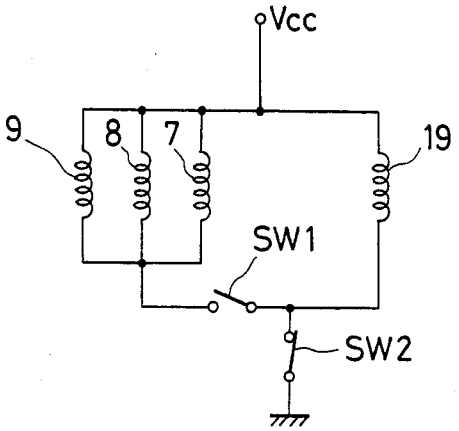
FIG. 9 is a circuit diagram of an excitation circuit for the electromagnet of FIG. 1.

FIGS. 8(A) and 8(B) are explanatory of operation of the electromagnet 1 according to the first embodiment, the views showing the yoke 11 and surrounding parts. FIG. 9 shows a circuit arrangement of an excitation circuit for the electromagnet 1. Operation of the electromagnet 1 will be described hereinbelow with reference to FIGS. 2, 8(A), 8(B), and 9. When the yokes 10, 11, 12 (FIG. 2) are not magnetized, the movable body 3 remains urged to the left (FIG. 2) as by a return spring (not shown) acting on the load end of the shaft 5. The fixed body 2 and the movable body 3 are relatively positioned at this time as illustrated in FIG. 8(A). More specifically, the front ends of the magnetic members 22*a*, 22*b*, 22*c* of the movable body 3 are positioned slightly rearward of the rear ends of the magnetic members 20*a*, 20*c*, 20*e* of the fixed body 2. When switches SW1, SW2 (FIG. 9) are closed, the coils 7, 8, 9, 19 are energized to magnetize the yokes 10, 11, 12, a magnetic flux is produced in the direction of the arrow S1 (FIG. 8(A)). The magnetic members 22*a*, 22*b*, 22*c* of the movable body 3 are now attracted to the right under attractive forces from the yokes 10, 11, 12. The magnetic members 22*a*, 22*b*, 22*c*, are moved to positions between the magnetic members 20*a*, 20*b*; 20*c*, 20*d*; 20*e*, 20*f* of the fixed body 2 so that the magnetic reluctance will be minimized, as shown in FIG. 8(B). Upon movement of the movable body 3, the shaft 5 supported by the base 6 is pushed to the right for operating a load such as a control valve. When the movement of the movable body 3 is completed, the switch SW1 is opened to demagnetize the yokes 10, 11, 12, and the movable body 3 is held in the position of FIG. 8(B) only by the attractive forces produced by the coil 19. When the switch SW2 is thereafter opened, the movable body 3 is moved back to the initial position of FIG. 8(A) as by the return spring attached to the shaft 5.

Figure 10A:
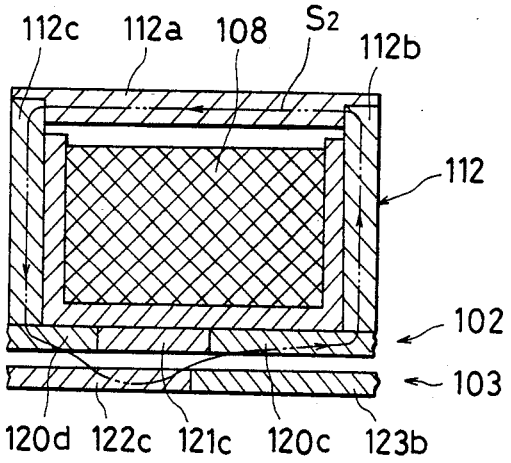
FIGS. 10(A) and 10(B) are enlarged fragmentary cross-sectional views showing operation of the electromagnet of FIG. 4.
Figure 10B:
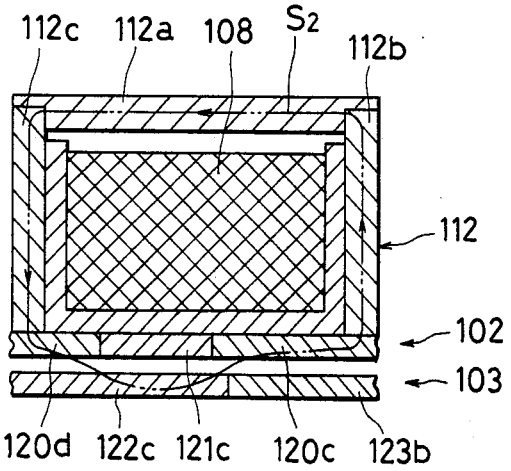

FIGS. 10(A) and 10(B) are explanatory of operation of the electromagnet 101 according to the second embodiment, the views showing the yoke 112 and surrounding parts. Operation of the electromagnet 101 will be described hereinbelow with reference to FIGS. 5, 10(A), and 10(B). When the yokes 110 through 113 are not magnetized, the movable body 103 remains urged to the left (FIG. 5) as by a return spring (not shown) acting on the load end of the shaft 105. The fixed body 102 and the movable body 103 are relatively positioned at this time as illustrated in FIG. 10(A). More specifically, the front ends of the magnetic members 122*a* through 122*d* of the movable body 103 are positioned slightly rearward of the rear ends of the magnetic members 120*a* through 120*d* of the fixed body 102. When the coils 106 through 109 are energized to magnetize the yokes 110 through 113, a magnetic flux is produced in the direction of the arrow S2 (FIG. 10(A)). The magnetic members 122*a* through 122*d* of the movable body 103 are now attracted to the right under attractive forces from the yokes 110 through 113. The magnetic members 122*a* through 122*d* are moved to positions between the magnetic members 120*a*, 120*b*; 120*b*, 120*c*; 120*c*, 120*d*; 120*d*, 120*e* of the fixed body 102 so that the magnetic reluctance will be minimized, as shown in FIG. 10(B). Upon movement of the movable body 103, the shaft 105 operates a control valve, for example. When the coils are de-energized to demagnetize the yokes 110 through 113, the movable body 103 is moved back to the initial position of FIG. 10(A) as by the return spring attached to the shaft 105.

The electromagnets 1 and 101 are operated in the manner described above. At an initial stage of energization, eddy currents are induced in the movable bodies 3, 103 due to electromagnetic induction. The eddy currents flow through the magnetic members 22*a* through 22*e*, 122*a* through 122*d* in the circumferential direction of the movable bodies 3, 103, and the magnetic fluxes produced by the eddy currents act to cancel out the magnetic forces produced by the magnetization of the yokes. Since the circulation paths for the eddy currents are cylindrical and divided by the nonmagnetic members, the circulation paths are narrow and long. Therefore, the electric resistances to the eddy currents are increased to suppress the eddy currents. Therefore, the magnetic forces produced by the yokes as magnetized are prevented from being cancelled by the eddy currents. The resistances of the circulation paths can be increased by employing the movable bodies 30, 130 having the axially parallel slits 32*a* through 32*c*; 132*a* through 132*d*, respectively. Inasmuch as the excitation coils 7 through 9; 106 through 109 are separate and connected parallel to each other, the inductance can be reduced. The movable bodies 3, 103 are much less heavy than conventional solid movable bodies since the movable bodies 3, 103 are in the form of the hollow cylindrical bodies having required cross-sectional areas.

With the arrangement of the present invention, as described above, the movable body is in the form of a hollow cylindrical body providing circulation paths for eddy currents, which have large electric resistances to reduce the eddy currents, while keeping the desired cross-sectional area for the magnetic circuits. The cylindrical movable body is light in weight, and the excitation coils of the fixed body are separate and connected parallel to each other for reducing the inductance. Therefore, the magnetic forces when produced are increased quickly for attaining an increased response of the electromagnet and increased magnetic forces with which the movable body can be attracted. By arranging the yokes in axial juxtaposition, the electromagnet may be designed for use with various loads such as valves. The electromagnet of the invention can be lightweight and small in size.

Although certain preferred embodiment have been shown and described, it should be understood that many changes and modifications may be made therein without departing from the scope of the appended claims.

What is claimed is:

1. An electromagnetic actuator comprising:

a hollow cylindrical movable body including a stack of hollow cylindrical magnetic members interposed with hollow cylindrical non-magnetic members, said movable body having a wall thickness of substantially 1 mm; and an associated fixed body, including a stack of magnetic yokes each carrying an electrical coil adapted to be energized to create a magnetic field to effect movement of said movable body.

2. An electromagnetic actuator assembly comprising:

a fixed body having electric coil means for generating a magnetic field mounted thereon including a plurality of magnetic yoke members each carrying an electrical coil; and a hollow cylindrical movable body adapted to be slidable over said fixed body including a plurality of hollow cylindrical magnetic members interposed with a plurality of hollow cylindrical non-magnetic members, said hollow cylindrical movable body having a wall thickness that is substantially 1 mm to effect a high speed kinetic response to the generation of a magnetic field by said coil means.

3. An electromagnet according to claim 1, wherein said movable body is axially movably fitted over said fixed body.

4. An electromagnet according to claim 1, wherein said yokes are cylindrical, said movable body being axially movably fitted in said fixed body.

5. A electromagnet according to claim 1, wherein said movable body has axially parallel slits defined in said magnetic members.

6. An electromagnet according to claim 3 wherein said movable body has axially parallel slits defined in said magnetic members.

7. An electromagnet according to claim 4 wherein said movable body has axially parallel slits defined in said magnetic members.

8. An electromagnetic actuator assembly according to claim 2 wherein said movable body has axially parallel slits defined in said magnetic members, whereby eddy current loss is decreased.

9. An electromagnetic actuator assembly according to claim 2, further comprising a plurality of disks which are provided between said magnetic yoke members.

10. An electromagnetic actuator assembly according to claim 2, wherein said fixed body further comprises a bottomed cylindrical body for mounting over said yoke members, said cylindrical body comprising a plurality of cylindrically shaped magnetic elements which are interposed with a plurality of cylindrically shaped non-magnetic elements, whereby said coil means magnetizes said magnetic elements, causing said movable body to move with respect to said fixed body.

11. An electromagnetic actuator as in claim 1, wherein said magnetic and non-magnetic members are alternatively disposed in said stack.

* * * * *